United States Patent [19]

Matsuda et al.

[11] Patent Number: 4,730,443

[45] Date of Patent: Mar. 15, 1988

[54] APPARATUS FOR FOLDING FRONT AND REAR FLAPS IN A WRAPAROUND CASER

[75] Inventors: Katsumi Matsuda; Kunio Kono, both of Hiroshima, Japan

[73] Assignee: Mitsubishi Jukogyo Kabushiki Kaisha, Tokyo, Japan

[21] Appl. No.: 896,289

[22] Filed: Aug. 13, 1986

[30] Foreign Application Priority Data

Sep. 10, 1985 [JP] Japan ..... 60-198652

[51] Int. Cl.[4] ..... B65B 11/08

[52] U.S. Cl. ..... 53/580; 53/207; 53/209; 53/252

[58] Field of Search ..... 53/462, 207, 209, 580, 53/252

[56] References Cited

U.S. PATENT DOCUMENTS

| | | | |
|---|---|---|---|
| 2,932,929 | 4/1960 | Fahrenbach | 53/580 |
| 3,383,825 | 5/1968 | Titchenal | 53/207 X |
| 3,555,776 | 1/1971 | Nigrelli | 53/580 |
| 3,842,570 | 10/1974 | Monaghan | 53/580 X |
| 4,215,525 | 8/1980 | Nigrelli | 53/580 |
| 4,424,658 | 1/1984 | Focke | 53/462 X |

*Primary Examiner*—John Sipos

*Attorney, Agent, or Firm*—Wenderoth, Lind & Ponack

[57] ABSTRACT

The known type of front and rear flap folding apparatus in a wraparound caser in the prior art is improved in that the folding apparatus comprises front flap folding means in which when an article is fed from a dead plate onto a flat blank sheet that is being transported as placed on a sheet receiver of a case transporting conveyor, front flap folding guide members mounted to the case transporting conveyor are erected by a roller follower which rolls along a cam rail to fold the front flap of the sheet, rear flap folding means in which after the article has been fed onto the sheet, rear flap folding guide members mounted to the case transporting conveyor are erected by a roller follower which rolls along a cam rail to fold the rear flap of the sheet, and combined guide and press members which press the article and the sheet while guiding the article upon the above-mentioned folding operations to prevent them from rising up from the sheet receiver.

4 Claims, 9 Drawing Figures

APPARATUS FOR FOLDING FRONT AND REAR FLAPS IN A WRAPAROUND CASER

BACKGROUND OF THE INVENTION

1. Field of the Invention

The present invention relates to an apparatus for folding front and rear flaps in a high speed wraparound caser, in which caser when a flat sheet delivered from a magazine is being transported as placed on a sheet receiver of a case transporting conveyor, an article is fed onto the same sheet while the article is being delivered in the same direction as the direction of traveling of the sheet by means of an article transporting conveyor and a dead plate, flaps provided at the front, rear, left and right locations of the same sheet are folded, and then pasting, pressing and pressure-sticking are effected.

2. Description of the Prior Art

At first, a wraparound caser in the prior art will be explained with reference to FIGS. 8 and 9. In these figures, reference numeral (100) designates a vacuum cup arm which is interconnected with a link (101) via a rotatably supported pin (102), and hence the vacuum cup arm (100) and the link (101) can rock integrally about the pin (102) forming a fulcrum point. Reference numeral (103) designates a driving link; a link (104) and a link (105) are successively articulated to the link (103), and a four-articulate linkage is formed by these links. In addition, if a link (107) that is pivotably mounted at an appropriate point (106) on the same link (104) is rotatably articulated to the above-described link (101), then in response to rotation of the driving link (103), the vacuum cup arm (100) would rock between a position (100*a*) and a position (100*b*) and would perform an intermittent motion in which it stops for a predetermined period at the position (100*b*).

On the other hand, in another four-articulate linkage including a link (108) as a driving link and formed of that driving link (108) and links (109) and (110), an appropriate point (111) on the link (109) would depict an elliptic locus in response to rotation of the driving link (108). Reference numeral (112) designates case pushers which are fixedly secured to mount bars (112*a*) that is rotatably mounted at the point (111) on the link (109). In addition, if a guide bar (114) that is freely slidable with respect to a housing (113) rotatably mounted on a machine wall (not shown) is fixedly secured to the mount bar (112*a*), then in response to rotation of the driving link (108), the case pusher (112) performs forward and backward traveling motions as well as a jumping motion in the proximity of the forward traveling end. Reference numeral (115) designates suction arms which are rocked by a cam mechanism not shown, and vacuum cups (116*a*) and (116*b*) are mounted at their tip ends. Reference numeral (117) designates a seam hook that is rocked by a cam mechanism not shown, reference numerals (118*a*) and (118*b*) designate side hooks which are rocked by a cam mechanism not shown, numerals (119*a*) and (119*b*) designate bottom flap tackers which are rocked by a cam mechanism not shown, and numerals (120) and (121) designate bucket conveyor guides provided on chains (122) which are stretched in an endless form.

In the above-described wraparound caser, the driving links (103) and (108), the respective cams for driving the suction arm (115), the seam hook (117), the side hooks (118*a*) and (118*b*) and the bottom flap tackers (119*a*) and (119*b*), respectively, and the chains (122) of the bucket conveyor are regulated in their mutual timing, and so, they are driven in a synchronized manner. Each of flat blank sheets (125) stacked in a magazine is sucked by vacuum cups (124) mounted on the vacuum cup arm (100) at its position (100*a*), and when it moves to its position (100*b*), it is folded into a U-shape as shown at (124') by fixed guides (126) and (127). At this time, bottom flaps of the blank sheet are pressed on transporting rails (128) by means of the bottom flap tacker (119*a*) and (119*b*) to prevent the folded sheet or the case from floating up. During the period when the vacuum cup arm (100) stops for a while under such condition, the case pushers (112) deliver the case (124') folded into a U-shape to the bucket conveyor, in which the case (124') folded into a U-shape is transported as sandwiched by the bucket conveyor guides (120) and (121) while the bottom flaps are pressed by fixed guides (129).

Although the above-described operation is satisfactory upon low speed operation, if the apparatus enters high speed operation, when the flat blank sheet (124) is sucked at the position (100*a*), pick-up of the blank sheet becomes difficult due to a vacuum force generated by the abrupt separation of the overlapped flat blank sheets (124). In order to obviate this difficulty, a single sheet separation mechanism for the flat blank sheets is provided. More particularly, this mechanism is composed of the suction arms (115) which are rocked by a cam mechanism, the seam hook (117) and the side hooks (118*a*) and (118*b*). At the timing when the vacuum cups (116*a*) and (116*b*) on the suction arms (115) suck the flat blank sheet (124) at the bottom of the magazine (123), the seam hook (117) releases the blank sheets (124) and the side hooks (118*a*) and (118*b*) support the blank sheets (124). When the suction arm (115) has rocked and one of the blank sheets (124) has been separated, the seam hook (117) is rocked in the direction for pressing the blank sheets (124) to support the remaining blank sheets (124), thereafter the side hooks (118*a*) and (118*b*) are released, and the blank sheet (124) at the bottom can be perfectly separated from the other blank sheets (124). At this timing, pick-up of the blank sheet becomes possible by effecting suction of the blank sheet by the vacuum cups (125) on the above-described vacuum cup arm (100).

In the wraparound caser in the prior art shown in FIGS. 8 and 9, since the sheet (124') pulled out from the magazine (123) and shaped into a U-shape by a shaping device is transported by merely supporting the front and rear flaps of the shaped sheet (124') with the bucket conveyor guides (120) and (121) fixedly mounted to the chains (122) of the bucket conveyor stretched in an endless manner, it is difficult to adjust the erect shaping angle of the bucket conveyor guides (120) and (121) during the transportation. Also, besides the case transporting conveyor, a shaping device and an article feeding device for feeding an article along a direction perpendicular to the direction of traveling of the conveyor are necessitated, and there is a fear that a fed article may drop out of the sheet (124') shaped into a U-shape. In addition, the entire wraparound caser becomes large-sized due to the above-mentioned respective devices, a wide space is required for installation of the wraparound caser, and a high cost results. Furthermore, there is a problem that the structure of the wraparound caser is complex and a lot of time is required for maintenance.

SUMMARY OF THE INVENTION

It is therefore one object of the present invention to provide an improved apparatus for folding front and rear flaps in a high speed wraparound caser, in which articles can be fed stably to a sheet that is being transported, an erect shaping angle of front and rear flap folding guide members can be adjusted, a manufacturing cost of the wraparound caser can be reduced, and maintenance can be achieved easily.

According to one feature of the present invention, there is provided an apparatus for folding front and rear flaps in a high speed wraparound caser, in which caser when a flat sheet delivered from a magazine is being transported as placed on a sheet receiver of a case transporting conveyor, an article is fed onto the sheet while the article is being delivered in the same direction as the direction of traveling of the sheet by means of an article transporting conveyor and a dead plate, flaps provided at the front, rear, left and right locations of the sheet are folded, and then pasting, pressing and pressure-sticking are effected, which folding apparatus is improved in that it comprises front flap folding means in which when the article is fed from the dead plate onto the sheet that is being transported as placed on the sheet receiver of the case transporting conveyor, front flap folding guide members mounted to the case transporting conveyor are erected by a roller follower which rolls along a cam rail to fold the front flap of the sheet, rear flap folding means in which after the article has been fed onto the sheet rear flap folding guide members mounted to the case transporting conveyor are erected by a roller follower which rolls along a cam rail to fold the rear flap of the sheet, and combined guide and press members which press the article and the sheet while guiding the article upon the above-mentioned folding operations to prevent them from floating up from the sheet receiver.

According to the present invention, since the apparatus for folding front and rear flaps in a high speed wraparound caser is constructed in the above-described manner, when the article is fed from the dead plate onto the sheet that is being transported as placed on the sheet receiver of the cam transporting conveyor, front flap folding guide members in the front flap folding means mounted to the case transporting conveyor are erected by the roller follower which rolls along the cam rail, and fold the front flap of the sheet. At this time, the article fed onto the sheet strikes against the same erected front flap, and so, the front flap serves as a stopper. In addition, under this condition, rear flap folding guide members in the rear flap folding means mounted to the case transporting conveyor are erected by the roller follower which rolls along the cam rail, and fold the rear flap of the sheet. Furthermore, during the above-mentioned folding operations, the combined guide and press members press the article and the sheet while guiding the article, and prevent them from rising up from the sheet receiver. Therefore, if the mounting position of the cam rail is changed, the erect shaping angle of the front and rear flap folding guide members can be adjusted.

The above-mentioned and other objects, features and advantages of the present invention will become more apparent by reference to the following description of one preferred embodiment of the invention taken in conjunction with the accompanying drawings.

BRIEF DESCRIPTION OF THE DRAWINGS

In the accompanying drawings:

FIG. 5 (II) is a cross-sectional front view taken along line B—B in FIG. 3 as viewed in the direction of arrows;

FIG. 6 (II) is a cross-sectional front view taken along line E—E in FIG. 1 as viewed in the direction of arrows;

DESCRIPTION OF THE PREFERRED EMBODIMENT

Figure 6:
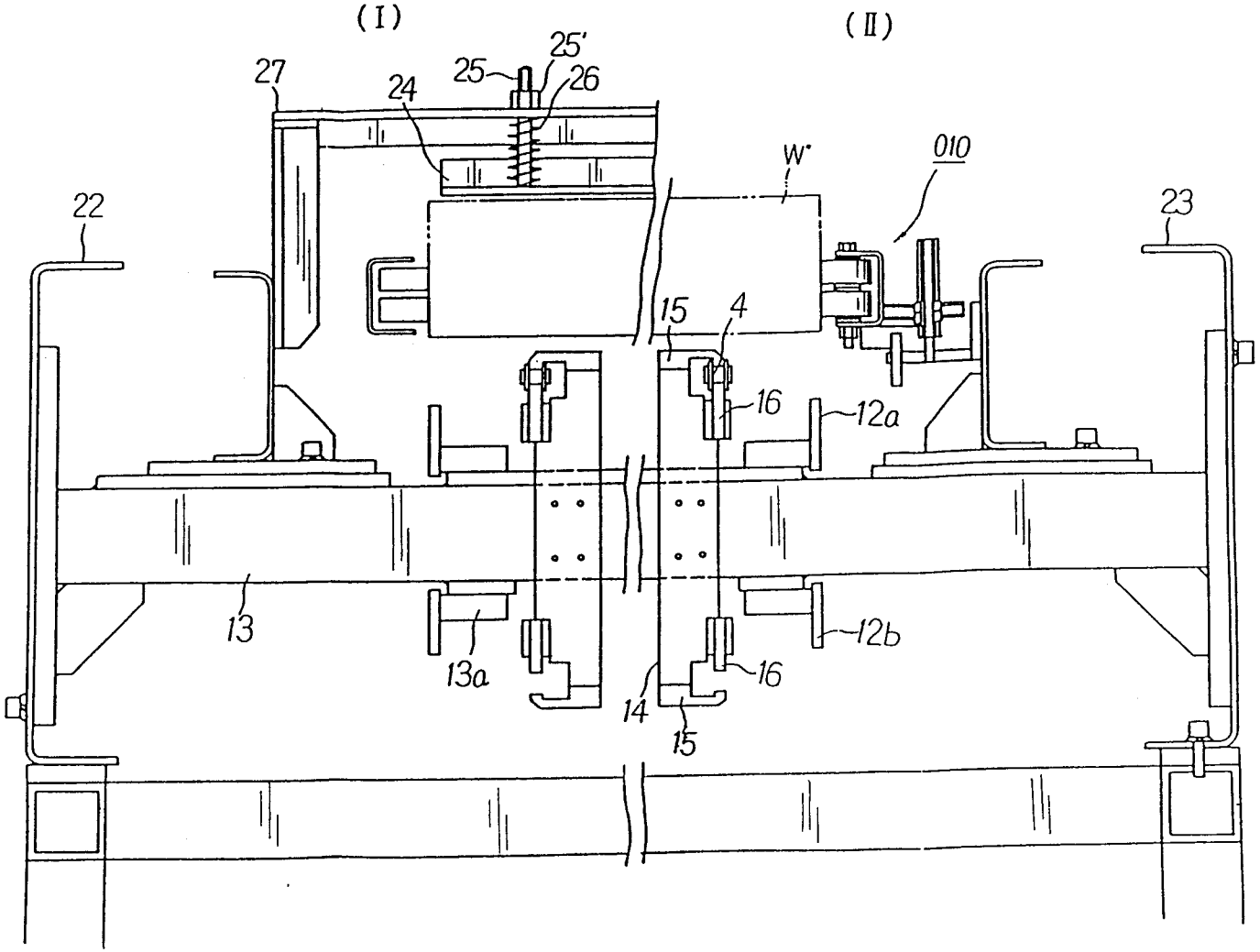
FIG. 6 (I) is a cross-sectional front view taken along line D—D in FIG. 1 as viewed in the direction of arrows.
Figure 7:
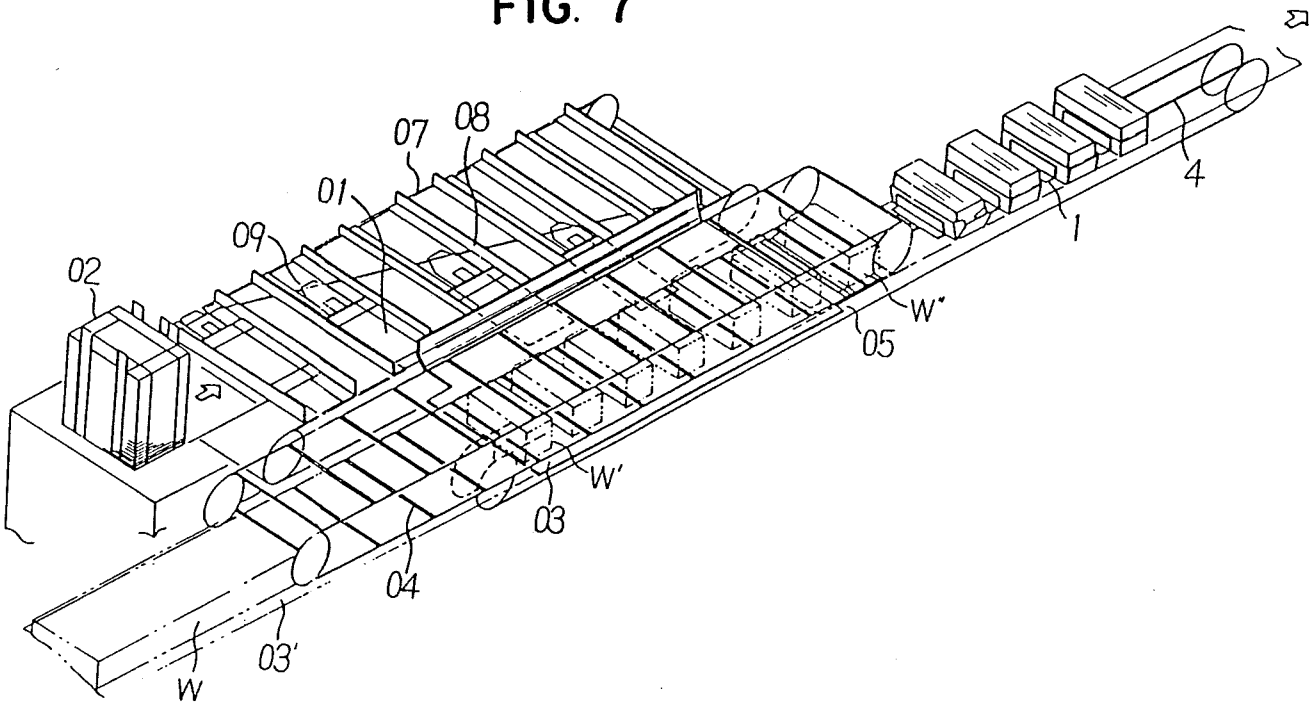
FIG. 7 is a perspective view showing the relations between the apparatus for folding front and rear flaps according to the present invention and the apparatuses other than the folding apparatus, that is, a sheet feeding apparatus, an article feeding apparatus and a side flap folding apparatus.
Figure 8:
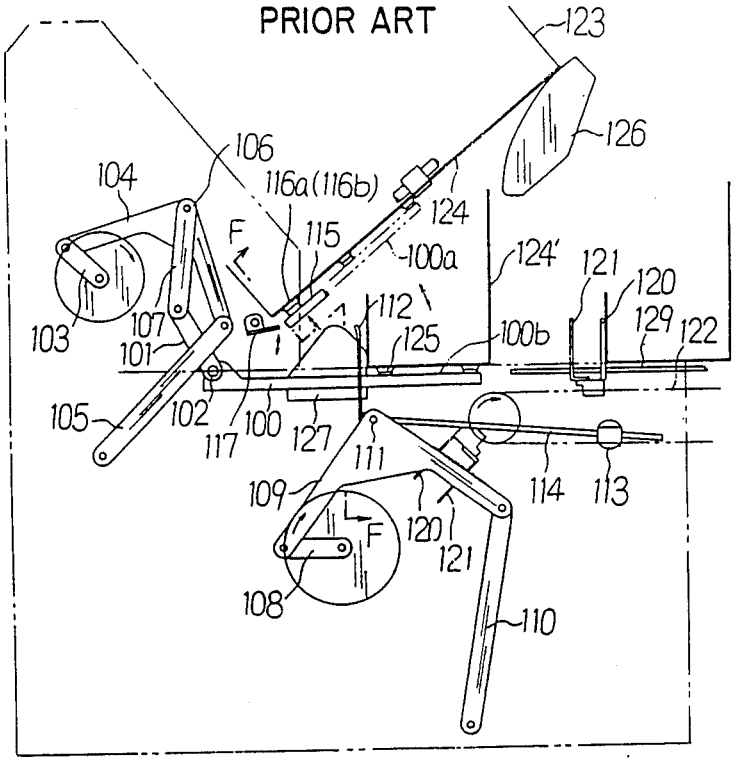
FIG. 8 PRIOR ART
FIG. 8 is a side view showing a wraparound caser in the prior art.
Figure 9:
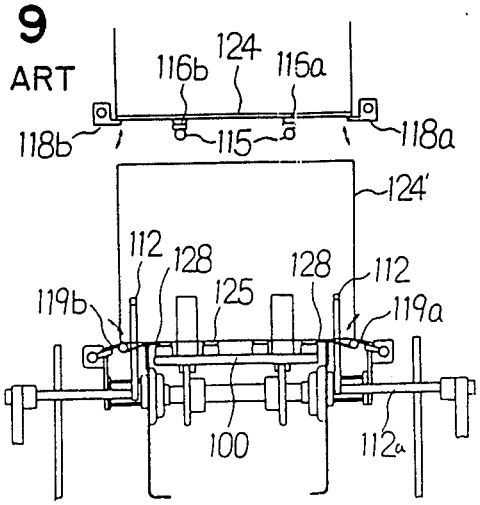
FIG. 9 PRIOR ART
FIG. 9 is a cross-sectional front view taken along line F—F in FIG. 8 as viewed in the direction of arrows.

Now, the apparatus for folding front and rear flaps in a high speed wraparound caser according to the present invention will be described with reference to one preferred embodiment thereof shown in FIGS. 1 through 7. At first, description will be made on the respective apparatuses operating in the preceding and succeeding steps of a process in association with the apparatus for folding front and rear flaps according to the present invention. With reference to FIG. 7, there are shown a sheet delivery apparatus which delivers flat sheets (01) stacked in a magazine (02) one by one from the lowermost position and transports it by means of a magazine conveyor (07) (if necessary, refer to Specification of Japanese Patent Application No. 60-138120), and an article feeding apparatus which continuously transfers the sheet (01) that is being transported by the magazine conveyor (07) along sheet slider guide rails (08) to an adjacent article transporting conveyor (03') that is driven in synchronism with the same magazine conveyor (07), and separates and feeds an article (W) that has come while sliding along a dead plate (03) onto the sheet (01) on the above-mentioned article transporting conveyor (03') by means of flight bars (04) that is driven in synchronism with the same article transporting conveyor (03') (see (W')). The apparatus for folding front and rear flaps according to the present invention operates to fold front and rear flaps of the sheet (01) into a U-shape, which sheet has an article fed thereon from the above-mentioned article feeding apparatus and which has been transferred from the article transporting conveyor (03') onto the case transporting conveyor (1) and is subsequently being transported. In addition, on the downstream side in the direction of transportation of the apparatus for folding front and rear flaps according to the present invention, is installed a side flap folding apparatus for folding left and right flaps of the sheet (01) that is subsequently being transported by the case transporting conveyor (1) (if necessary, refer to Specification of Japanese Patent application No. 60-148203), and further for the next step of the process, there is provided a pressure-sticking shaping apparatus (see (010) in FIG. 6(II)), in which pasting, pressing and pressure-sticking of the sheet (01) shaped into a case form are effected. Here it is to be noted that reference numerals designating parts of the above-mentioned respective apparatuses other than the apparatus for folding front and rear flaps according to the present invention are attached with a digit "0" at their most significant digit position to distinguish them from those of the front and rear flap folding apparatus according to the present invention.

Figure 1:
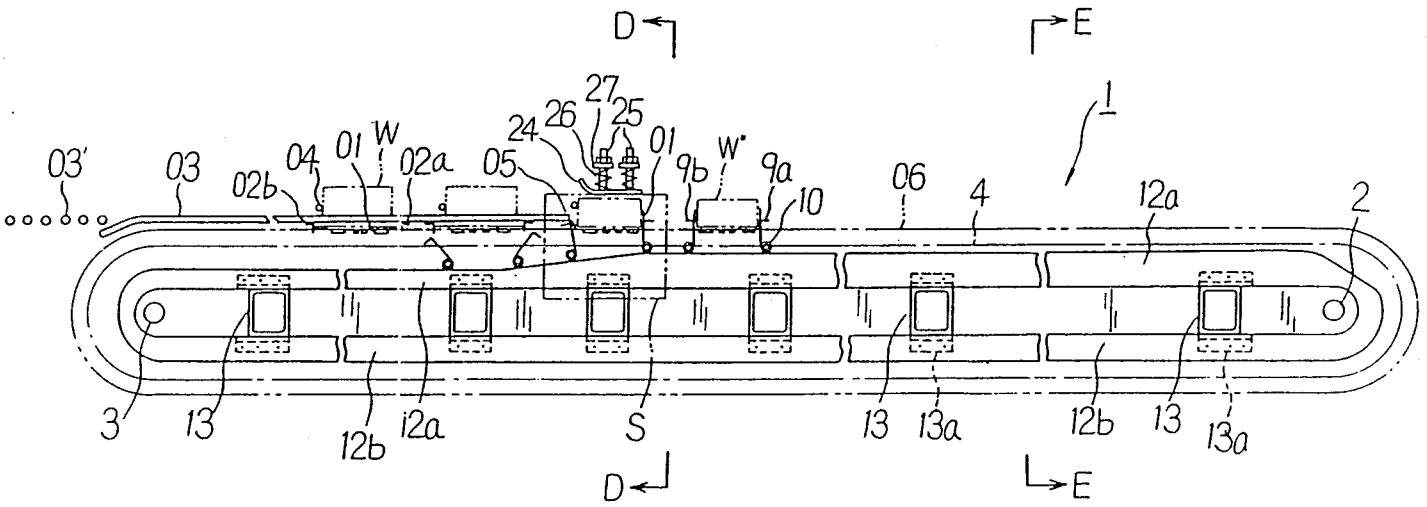
FIG. 1 is a side view showing one example of a high speed wraparound caser embodying the present invention.
Figure 2:
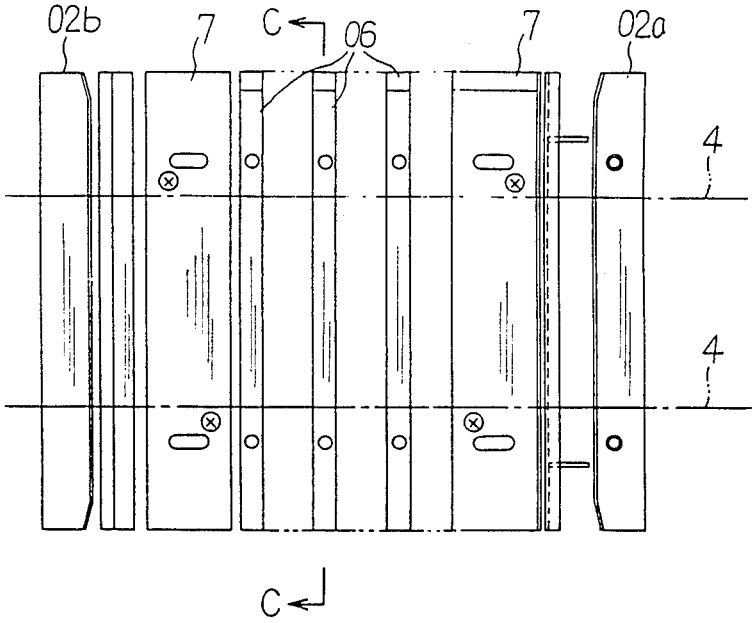
FIG. 2 is a plan view showing a part of a case transporting conveyor used in the wraparound caser in FIG. 1.
Figure 3:
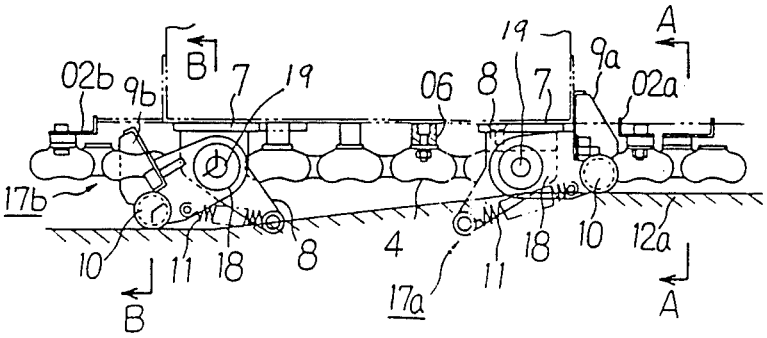
FIG. 3 is a side view of the same part of the case transporting conveyor in FIG. 2.
Figure 4:
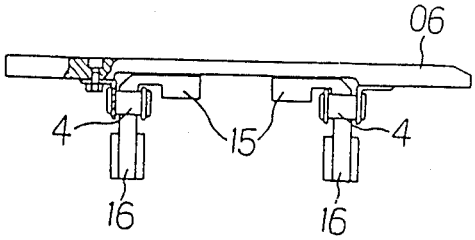
FIG. 4 is a cross-sectional front view taken along line C—C in FIG. 2 as viewed in the direction of arrows.
Figure 5:
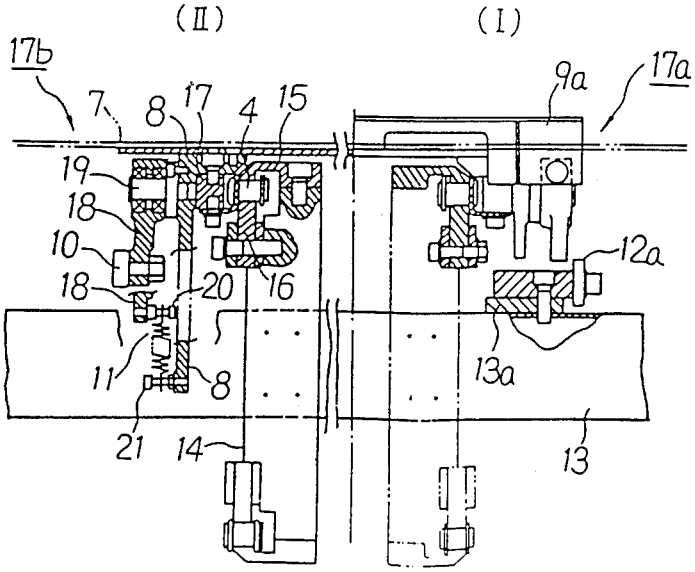
FIG. 5 (I) is a cross-sectional front view taken along line A—A in FIG. 3 as viewed in the direction of arrows.

Next, the front and rear flap folding apparatus according to the present invention will be explained in greater detail with reference to FIGS. 1 to 7. In FIG. 1, reference numeral (1) designates a case transporting conveyor, numeral (2) designates a drive shaft, numeral (3) designates a driven shaft, and the drive shaft and the driven shaft (3) are rotatably mounted via bearings to main body frames (22) and (23) (see FIG. 6). In addition, to the drive shaft (2) and to the driven shaft (3) are mounted two sprockets for each (not shown), and left and right endless chains (4),(4) are equipped between the respective sprockets. It is to be noted that the above-mentioned drive shaft (2) is driven by a driving apparatus not shown. On the outside of the above-described left and right endless chains (4),(4) are provided left and right endless cam rails (numeral (12*a*) designating an upper side cam rail, while numeral (12*b*) designating a lower side cam rail), respectively; these cam rails (12*a*,12*b*) are fixed to a plurality of stays (13) (see FIGS. 1, 5 and 6) via mount seats (13*a*) (see FIGS. 5 and 6), and the respective stays (13) are fixedly secured to the main body frames (22) and (23). It is to be noted that the semi-circular sections at the opposite ends of the respective cam rails (12*a*,12*b*) surround the above-mentioned drive shaft (2) and driven shaft (3). In FIGS. 1, 2 and 3, reference numerals (02*a*) and (02*b*) designate front and rear sheet guide members, numeral (06) designate a plurality of sheet receivers, numeral (7) designates sheet receiver plates, and these sheet guide members (02*a*) and (02*b*), the respective sheet receivers (06) and the respective sheet receiver plates (7) interconnect the left and right endless chains (4),(4). Reference numerals (15) and (16) in FIGS. 4, 5 and 6 designate chain rails for guiding the left and right endles chains (4),(4) by nipping the rollers in the endless chains (4),(4) from the above and the below, these chain rails (15) and (16) are also formed in an endless manner, and at a plurality of locations these chain rails (15) and (16) are fixed to the respective stays (13) via support plates (14). Reference numeral (17*a*) in FIGS. 3 and 5 designates a front flap folding mechanism, and reference numeral (17*b*)in FIGS. 3 and 5 designates a rear flap folding mechanism. At first, description will be made on the rear flap folding mechanism (17*b*) with reference to FIGS. 3 and 5. Among the above-mentioned respective sheet receiver plates (7), to the both left and right end portions of the sheet receiver plate (7) on the rear side are fixedly secured brackets (8), pins (19) are fixedly secured to the respective brackets (8), levers (18) are rotatably mounted to the pins (19), roller followers (10) are rotatably mounted at the tip end portions of the levers (18), springs (11) are interposed between the portions near to the tip ends of the lever (18) (bolts (20)) and the lower end portions (bolts (21)) of the brackets (8), and so, the roller followers (10) are held in resilient contact with the cam rails (12). In addition, rear flap folding guide members (9*b*) are fixedly secured to the above-mentioned levers (18), and when the roller followers (10) become to climb slope portions provided on the upper side cam rails (12*a*), the levers (18) rotate upwards about the pins (19), hence the rear flap folding guide members (9*b*) would erect and fold the rear flap of the sheet (01). The front flap folding mechanism (17*a*) is also constructed in an approximately similar manner. More particularly, among the above-mentioned respective sheet receiver plates (7), to the both left and right end portions of the sheet receiver plate (7) on the front side are fixedly secured brackets (8), pins (19) are fixedly secured to the respective brackets (8), levers (18) are rotatably mounted to the pins (19), roller followers (10) are rotatably mounted at the tip end portions of the levers (18), springs (11) are interposed between the portions near to the tip ends of the lever (18) (bolts (20)) and the lower end portions (bolts (21)) of the brackets (8), and so, the roller followers (10) are held in resilient contact with the cam rails (12*a*,12*b*). In addition, front flap folding guide members (9*a*) are fixedly secured to the above-mentioned levers (18), and when the roller followers (10) become to climb slope portions provided on the upper side cam rails (12*a*), the levers (18) rotate upwards about the pins (19), hence the front flap folding guide members (9*a*) would erect and fold the front flap of the sheet (01). In FIGS. 1 and 6, reference numeral (27) designates a beam fixedly secured to the above-mentioned stay (13), left and right adjusting bolts (25) penetrate through the same beam (27) so as to be movable in the vertical direction, nuts (25') are threadedly engaged with the upper portions of the respective adjusting bolts (25), a combined guide and press member (24) is fixedly secured to the bottom ends of the respective adjusting bolts (25), springs (26) are interposed between the combined guide and press member (24) and the above-mentioned beam (27) so as to respectively surround the adjusting bolts (25), and therefore, upon folding the front and rear flaps, the combined guide and press member (24) would press an article (W") and the sheet (01) while guiding the article (W") and would prevent them from floating up from the sheet receiver (06).

Now, the operation of the above-described apparatus for folding front and rear flaps in a high speed wrap-around caser will be explained in greater detail. As shown in FIG. 7, flat sheets (01) delivered from a magazine (02) and being transported by a magazine conveyor (07), are continuously transferred by sheet sliders (09) to an adjacent article transporting conveyor (03') that is driven in synchronism with the magazine conveyor (07), and also, articles (W) which slide on a dead plate (03) are separated (see (W')) by flight bars (04) driven in synchronism with the article transporting conveyor (03'), and fed onto the sheets (01) on the above-mentioned article transporting conveyor (03'). Reference character (W") designates the article fed onto the sheet (01). At this time, the top surface of the article (W") comes into contact with the combined guide and press member (24), and is guided thereby. Also, during this period, the roller followers (10) of the front flap folding mechanism (17*a*) begin to climb the slope portions provided on the upper side cam rail (12*a*), hence the levers (18) rotate upwards about the pins (19), the front flap folding guide members (9*a*) erect, and thereby the front flap of the sheet (01) is folded, so that the article (W") fed onto the sheet (01) strikes against the same erected front flap, and the front flap serves as a stopper. Subsequently, the roller followers (10) of the rear flap folding mechanism (17*b*) begin to climb the slope portions provided on the upper side cam rail (12*a*), hence the levers (18) rotate upwards about the pin (19), the rear flap folding guide members (9*b*) erect, and thereby the rear flap of the sheet (01) is folded. In addition, for the next step of the process, there is provided a pressure-sticking shaping apparatus (refer to (010) in FIG. 6(II)), in which pasting, pressing and pressure-sticking of the sheet (01) shaped into a case form, are effected.

As described in detail above, in the front and rear flap folding apparatus in a high speed wraparound caser according to the present invention, when an article is fed from the above-mentioned dead plate onto the sheet that is being transported as placed on a sheet receiver of a case transporting conveyor, front flap folding guide members of a front flap folding mechanism mounted to the case transporting conveyor are erected by roller followers which roll along cam rails to fold the front flap of the same sheet. At this time, an article fed onto the sheet strikes against the erected front flap, and so, the front flap serves as a stopper. When this condition has been realized, rear flap folding guide members of a rear flap folding mechanism mounted to the above-mentioned case transporting conveyor are erected by roller followers which roll along cam rails to fold the rear flap of the same sheet, and upon the above-mentioned folding operations, a combined guide and press member press the article and the sheet while guiding the article to prevent them from floating up from the sheet receiver, so that articles can be stably fed onto the sheets which are being transported. The erection and falling of the front and rear flap folding guide members are effected by means of cam rails whose mount positions are variable, and so, by varying the mount positions of the cam rails, the erect shaping angle of the front and rear flap folding guide members can be adjusted. Furthermore, feeding of articles, shaping of cases and transportation of wrapped articles are effected on a single line (case transporting conveyor line), hence an article feeding apparatus for feeding articles along the direction perpendicular to the direction of traveling of the conveyor is unnecessary, the entire structure can be simplified, a large space is not required for installation of the wraparound caser, and a manufacturing cost can be reduced. In addition, since the structure can be simplified as described above, there is an advantage that maintenance can be achieved easily.

While the present invention has been described above in connection to one preferred embodiment of the invention, as a matter of course it is intended that the present invention should not be limited to only the illustrated embodiment but various changes and modifications in design could be made without departing from the spirit of the present invention.

What is claimed is:

1. An apparatus for folding flaps of sheets having front and rear flaps into wraparound cases surrounding an article, the apparatus comprising:

an endless conveyor for transporting a sheet;

sheet guide means attached to said endless conveyor for pushing the sheet in the direction of travel of said endless conveyor;

means for supplying the sheet to said endless conveyor;

means for placing an article onto the sheet;

means for folding the sheet around the article;

means, attached to said endless conveyor, for guiding and pressing the article while the sheet is folded around the article;

said means for folding the sheet around the article having cam rail means disposed adjacent and radially spaced from said endless conveyor for transporting the sheet, front and rear flap folding guide members for folding respective front and rear flaps of the sheet, and pivotably attached to said endless conveyor for transporting the sheet, front and rear roller followers respectively attached to said front rear flap folding guide members, said front and rear roller followers being operatively associated with said cam rail means;

said front and rear roller followers adapted to pivot said pivotably attached front and rear flap folding guide members;

said means for placing an article onto the sheet having means for supplying the article in the direction of movement of the endless conveyor for transporting a sheet;

means for synchronizing the movement of said endless conveyor for transporting a sheet, said means for supplying the article in the direction of movement of said endless conveyor, and said front and rear flap folding guide members;

wherein, said cam rail means is adapted to deflect said front and rear roller followers in turn, whereby when the article is supplied in the direction of movement of said endless conveyor onto the sheet, the front roller follower contacts said cam rail, whereby said front roller follower is deflected, and, hence, said front flap folding guide member is pivotably rotated about its connection to said endless conveyor, and folds the front flap of the sheet, and the article contacts the folded front flap which serves as a stop for the article, then the rear flap is folded against the article by the rear flap folding guide member.

2. The apparatus of claim 1, wherein said means for supplying an article in the direction of movement of said endless conveyor comprises at least one flight bar, said at least one flight bar being driven in synchrony with said endless conveyor, and contacting the article for supplying the article in the direction of movement of said endless conveyor.

3. The apparatus of claim 2, further comprising a stationery dead plate attached to said endless conveyor, said dead plate being disposed adjacent said endless conveyor and said at least one flight bar;

said means for placing the article onto the sheet further comprising means for supplying the article to said dead plate;

wherein, said at least one flight bar supplies the article from said dead plate onto the sheet on said endless conveyor.

4. the apparatus of claim 1, further comprising:

a sheet feeding line for feeding the sheets onto said endless conveyor, and being adjacent and attached to said endless conveyor;

a magazine for holding a plurality of sheets to be fed onto said sheet feeding line;

means for supplying one sheet of the plurality of sheets from said magazine onto said sheet feeding line;

at least one sheet slider for sliding the sheet from said feeding line onto said endless conveyor, and being attached to said feeding line;

at least one sheet slider rail for guiding the sheet which is slid from said feeding line onto said endless conveyor by said sheet slider.

* * * * *